United States Patent [19]

Sato et al.

[11] 3,945,551

[45] Mar. 23, 1976

[54] NAILING MACHINE

[75] Inventors: Tutomu Sato; Kiyomi Horikawa, both of Takasaki; Masayoshi Hiroi, Fukushima; Shigeyuki Umino, Maebashi; Toshio Yamada, Takasaki; Takashi Takayama, Takasaki; Toru Kayamori, Takasaki, all of Japan

[73] Assignee: Max Kabushiki Kaisha, Tokyo, Japan

[22] Filed: Aug. 9, 1974

[21] Appl. No.: 496,006

[52] U.S. Cl. ..... 227/136; 227/130

[51] Int. Cl.[2] ..... B25C 1/04

[58] Field of Search ..... 227/130, 136

[56] References Cited

UNITED STATES PATENTS

| | | | |
|---|---|---|---|
| 3,330,462 | 7/1967 | Colechia et al. | 227/136 |
| 3,353,737 | 11/1967 | Howard et al. | 227/136 |
| 3,524,576 | 8/1970 | Bader | 227/136 |
| 3,568,908 | 3/1971 | Bader | 227/136 |
| 3,622,062 | 11/1971 | Goode et al. | 227/136 |
| 3,688,966 | 9/1972 | Perkins et al. | 227/136 |
| 3,703,981 | 11/1972 | Smith | 227/136 |

*Primary Examiner*—Granville Y. Custer, Jr.
*Attorney, Agent, or Firm*—Woodhams, Blanchard and Flynn

[57] ABSTRACT

A pneumatically operated nailing machine for driving nails by a main piston operated by compressed air. A nail feeding piston is actuated by compressed air, synchronous with the movement of the main piston. To make the feeding of nails smooth, a device to accelerate evacuation of compressed air from the nail feeding piston is attached and the nail feeding piston is resiliently engaged with a nail feeding pawl. The front end of the nail feeding pawl is provided with a cutting edge for cutting a steel wire connecting the nails. A nail magazine is provided with a flat nail placing plate so that the nails are always fed to a fixed position, and against which each of the contained nails is resiliently pressed. The fitting position of the nail placing plate is changeable to permit the use of nails of different lengths.

6 Claims, 17 Drawing Figures

NAILING MACHINE

BACKGROUND OF THE INVENTION

The present invention relates to a pneumatically operated nailing machine for continuously driving nails by a main piston which is operated by compressed air. The first requisite of the pneumatically operated nailing machine is that it can drive nails quickly and accurately.

Accordingly, an object of this invention is to provide a pneumatically operated nailing machine having a nail feeding piston mechanism that is capable of feeding nails quickly and accurately.

Another object of this invention is to provide a rapid compressed air evacuating device for the nail feeding piston, which permits quick nail feeding.

Still another object of this invention is to provide an engaging device for the nail feeding piston and a nail feeding pawl, which permits accurate and smooth nail feeding.

Yet another object of this invention is to provide a device for cutting a steel wire connecting the nails, both accurately and easily.

A further object of this invention is to provide a nail magazine that allows the use of nails of different lengths.

A still further object of this invention is to provide a nail placing plate designed to always feed the nails to a fixed position, in order that accurate nail feeding can be achieved.

DETAILED DESCRIPTION

Figure 1:
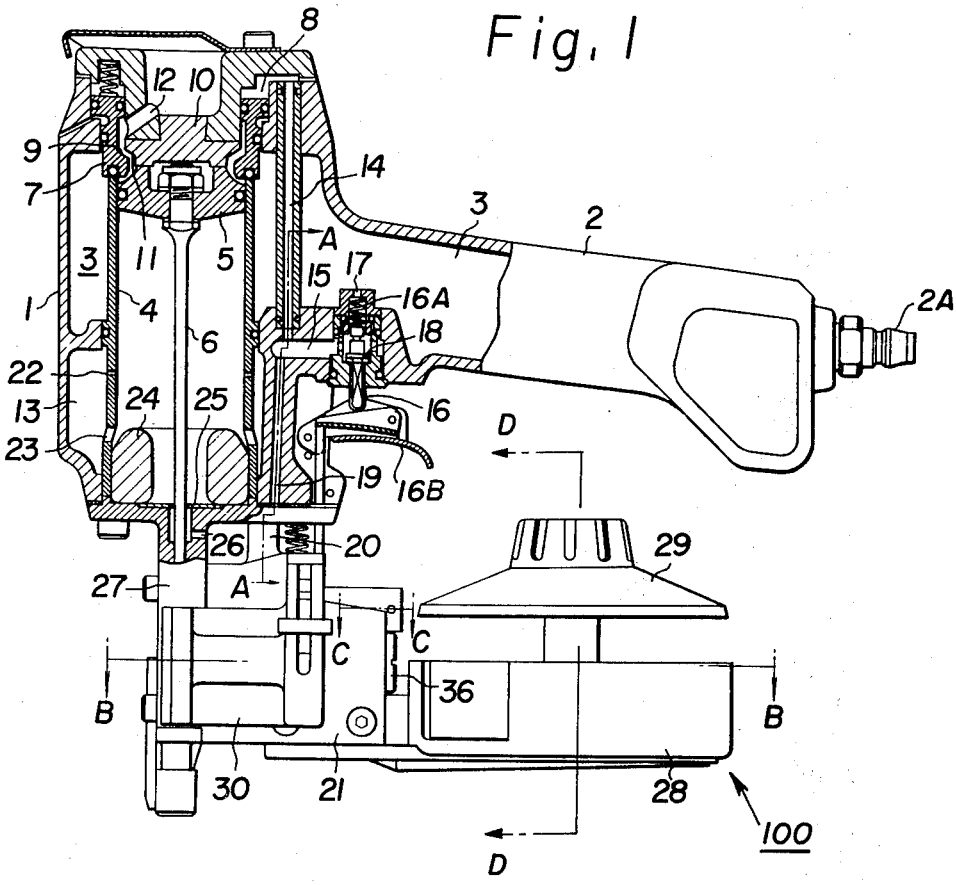
FIG. 1 is an overall view showing a pneumatically operating nailing machine, with a part thereof cut open.

In the first place, the general structure of a pneumatic nailing machine 100 will be briefly described with reference to FIG. 1.

At the side of a pneumatically operated nailing machine 100 having a housing 1 there is provided a handle portion 2, through which compressed air is supplied via a connector 2A to an air chamber 3 formed inside the housing 1. There is provided a fixed cylinder 4 inside the housing 1, and a main piston 5 is inserted therein. A driver 6 for driving nails is fixed below the main piston 5. On the top of the cylinder 4 there is provided a cylindrical head valve 7 which is concentrically and engagingly positioned relative to the upper edge of said cylinder 4 so as to separate the inside and outside thereof. This head valve 7 is fitted in such a manner that it reciprocatingly slides within an annular head valve air chamber 8 formed in the head portion of the housing. As may be seen in FIG. 1, the cross-sectional area of said head valve 7 is larger at the top than at the bottom, in order that the head valve 7 is moved upward and downward by the difference between the surface pressures working on the top and bottom thereof. The lower portion of the head valve 7 is formed as a flange 9, which serves to connect and disconnect the upper space in the cylinder with and from the atmosphere, alternatingly coming into contact with a base portion 11 of an upper bumper 10 mounted on the cylinder head. To permit this, a communicating passage 12 is formed in the housing head. The space between the cylinder 4 and the housing 1 is divided into upper and lower chambers 3 and 13, respectively.

While the upper chamber forms said air chamber 3, the lower one constitutes an air reservoir 13 for returning the piston, and it is separated from the aforesaid air chamber 3. When said head valve 7 moves upward, the air chamber 3 communicates with the upper space in the cylinder 4 located above the piston 5. Said head valve air chamber 8 communicates with an air reservoir 15 through a tube-formed air passage 14 provided within said air chamber 3. Said air reservoir 15 in turn communicates with a trigger valve air port 17 and a trigger valve opening 18, and thence with the air chamber 3 and the atmosphere, respectively. The port 17 and opening 18 are opened and closed by a trigger valve 16 which is normally urged downwardly by spring 16A to thus close the opening 18. Valve 16 is moved upwardly by a manually movable trigger device 16B. The air reservoir 15 also communicates with an air passage housing 20 through an air passage 19 formed inside the housing 1, and further actuates a nail feeding piston to be described later, which is provided within a nail feeding piston housing 21.

There are provided a small-diameter opening 22 and a large-diameter opening 23 in the lower portion of said cylinder 4. The purpose of the small-diameter opening 22 is to permit spouting of compressed air from the cylinder 4 to the air reservoir 13 when the main piston 5 descends. Therefore, said small-diameter opening 22 is provided at such a position that it communicates with the space within the cylinder 4 above the main piston 5, when the main piston 5 reaches the lowest point of its stroke. On the other hand, the large-diameter opening 23 is situated below the main piston 5 even when it descends to said lowest point, and introduces compressed air from the air reservoir 13 to below the main piston 5, thereby causing it to return to its original upper position.

A bumper 24 is provided in the bottom portion of the cylinder 4 for absorbing the shock of the descending main piston 5 that might otherwise impinge against the bottom of the cylinder 4. At the lowest end of cylinder 4 there is provided a disklike diaphragm 25, which in turn is provided with a hole that serves both for letting out air from the space in the cylinder 4 below the main piston 5 so that the air should not be compressed during the descending stroke of the main piston 5 and for passing the driver 6. Also, a communication port 26 is provided so that the air escaping through said diaphragm 25 can be let out into the atmosphere.

Said driver 6 is pushed down by the main piston 5 through a driver passage 27, thereby driving nails as described later. The nails are loaded in a nail magazine 28, in which they are held under the pressure of a magazine cap 29, and are supplied into said driver passage 27 past said nail feeding piston housing 21. A door 30, which can be freely opened and closed, is provided in the nail feeding piston housing 21, so that the feeding condition of the nails may be watched therethrough.

Next, a description will be given as to the cross-sectional view of FIG. 2 taken along the line A—A of FIG. 1, and referring also to FIG. 1.

As described previously, the space between the housing 1 and the cylinder 4 is divided into the air chamber 3 and the piston returning air reservoir 13. The air reservoir 15, communicating with the trigger valve 16 as shown in FIG. 1, communicates with the head valve air chamber 8 through the air passage 14 on one hand, and with an air passage 31 in the air passage housing 20 through the air passage 19 on the other, thence leading to a quick exhaust piston to be described later. The piston returning air reservoir 13 communicates with a nail feeding piston, which will be described later, provided in the air passage housing 20 through a passage 32 (FIG. 2) provided thereunder.

Now the operation of the device of this invention that is constructed as described above will be discussed hereunder.

Figure 2:
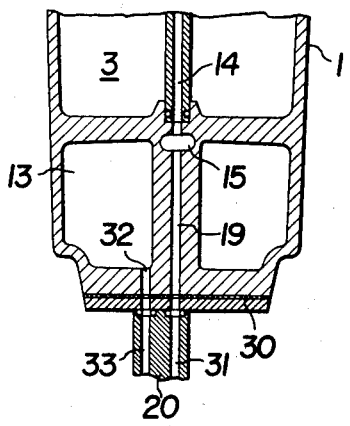
FIG. 2 is a cross section taken along the line A—A of FIG. 1.

First, it will be assumed that the device is in the stationary condition shown in FIG. 1. Because the trigger valve 16 is pushed downward by spring 16A, compressed air in the air chamber 3 is supplied to the air reservoir 15 through the trigger valve air port 17, and from there to the head valve air chamber 8 through the air passage 14 on one hand and to the quick exhaust piston through the air passages 19 and 31. Therefore, compressed air in the air chamber 8 presses down the head valve 7 to bring it into sealing contact with the upper end of the cylinder 4, thereby disconnecting the upper space in the cylinder 4 from the air chamber 3. However, the upper space in the cylinder 4 now communicates with the atmosphere through the passage 12, since the flange 9 formed on the head valve 7 is separated from the base portion 11 of the upper bumper 10. Compressed air discharged from the air passage 31, running past the quick exhaust piston (to be described later), actuates a nail feeding piston (to be described later) to a condition in which nails are fed.

Figure 3:
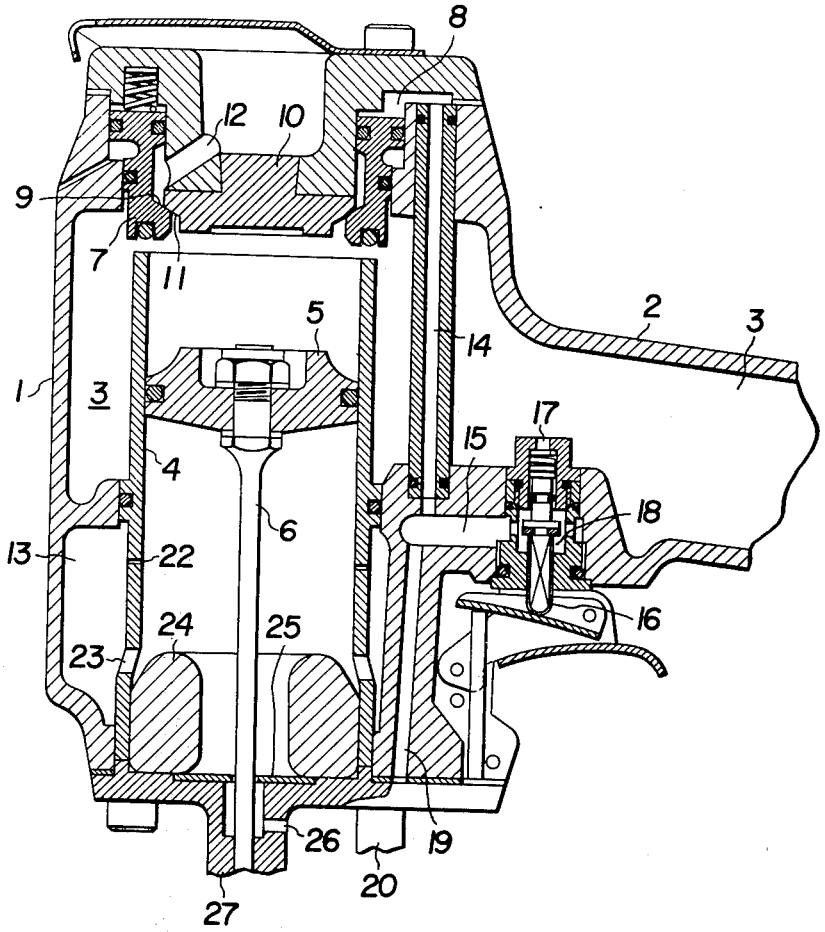
FIGS. 3 and 4 are cross sections illustrating the moving conditions of a main piston in FIG. 1.

On starting a nailing operation from the above-described condition, the trigger valve 16 is pushed up (see FIG. 3) whereby the trigger valve air port 17 is closed, while the trigger valve opening 18 is opened to cause the air reservoir 15 to communicate with the atmosphere. Consequently, the pressure in the head valve air chamber 8 becomes atmospheric, whereby the balance between the pressures working on the top and bottom of the head valve 7 is disturbed and, therefore, the head valve 7 moves upward (see FIG. 3) due to the pressure within chamber 3. As illustrated in FIG. 3, this upward movement of head valve 7 causes the flange 9 on the head valve 7 to sealingly contact the base portion 11 of the upper bumper 10, and also permits compressed air in the air chamber 3 to flow into the space above the main piston 5. The piston 5 is thus pushed downwardly by compressed air, whereupon the driver 6 descends through the driver passage 27 to hit the nail positioned therein.

Figure 4:
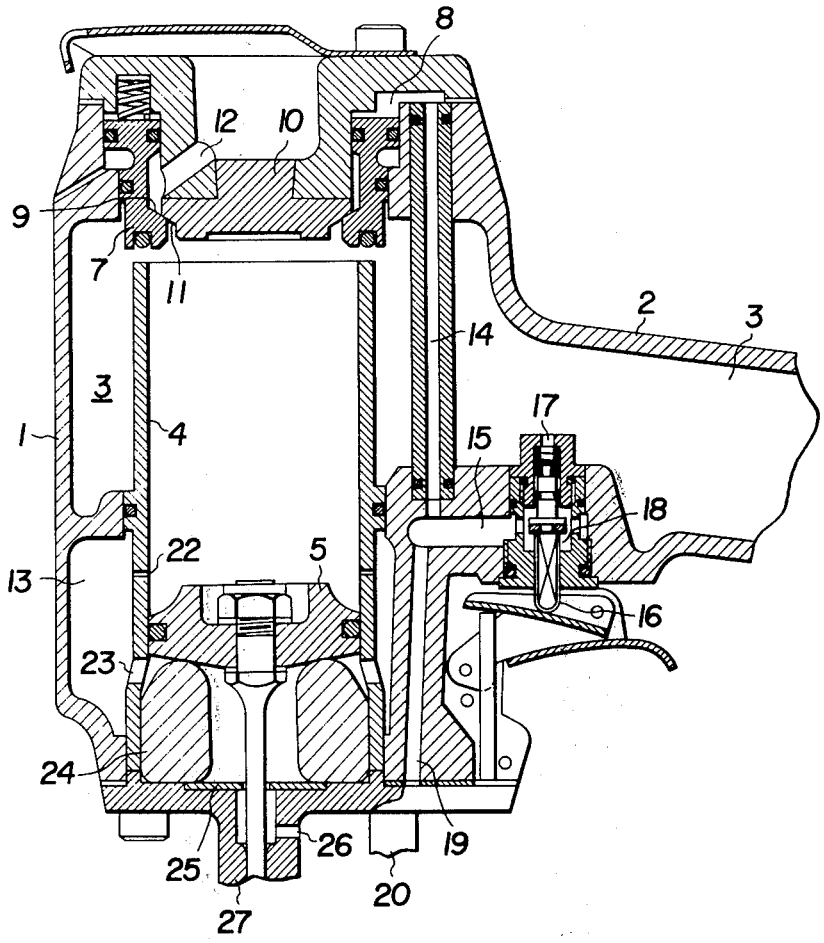

The main piston 5 descends to the position shown in FIG. 4 where it stops by impinging against the lower bumper 24. When the main piston 5 moves down to this position of FIG. 4, air in the space below said main piston 5 is let out into the atmosphere through the communication port 26 by way of the hole in the diaphragm 25. On completion of the descending stroke of the main piston 5, compressed air within the cylinder 4 flows into the air reservoir 13 through the small-diameter opening 22 provided in the lower portion of the cylinder 4. This compressed air which flows into the air reservoir 13 then flows through the air passages 32 and 33 (FIG. 2) to actuate the nail feed piston (to be described later).

Now the operation for returning the main piston 5 will be described.

On releasing the trigger valve 16 it is pushed down by spring 16A to the position of FIG. 1, whereby the trigger valve opening 18 is closed, and whereupon compressed air inside the air chamber 3 is introduced into the air reservoir 15 through the air port 17. As a consequence, pressure in the head valve air chamber 8 is increased, whereby the pressure working on the top of the head valve 7 becomes greater than that working on the bottom thereof and, therefore, the head valve 7 descends. The head valve 7 comes into sealing contact with the top end of the cylinder 4 to disconnect the air chamber 3 and the inside of the cylinder 4. Also, the flange 9 of the head valve 7 separates from the base portion 11 of the upper bumper 10, thereby letting out compressed air within the cylinder 4 into the atmosphere through the passage 12. Of the two openings provided in the lower portion of the cylinder 4, the small-diameter opening 22 offers greater resistance to the passage of air than the large-diameter opening 23, and therefore when the pressure inside the cylinder 4 is reduced, air in the piston returning air reservoir 13 flows in through said large-diameter opening 23 to work on the bottom surface of the main piston 5 to push it back to its upper position. At this time, the passage communicating with the atmosphere through the diaphragm 25 also does not hamper the upward return motion of the main piston 5 because the pressure level below the piston 5 is too low to force open the diaphragm 25. The compressed air introduced into the air reservoir 15 passes to the quick exhaust piston (described later) through the air passages 19 and 31, and further to the nail feeding piston to actuate it so that the next nail to be driven is pushed out into the bottom end of the driver passage 27.

Figure 5:
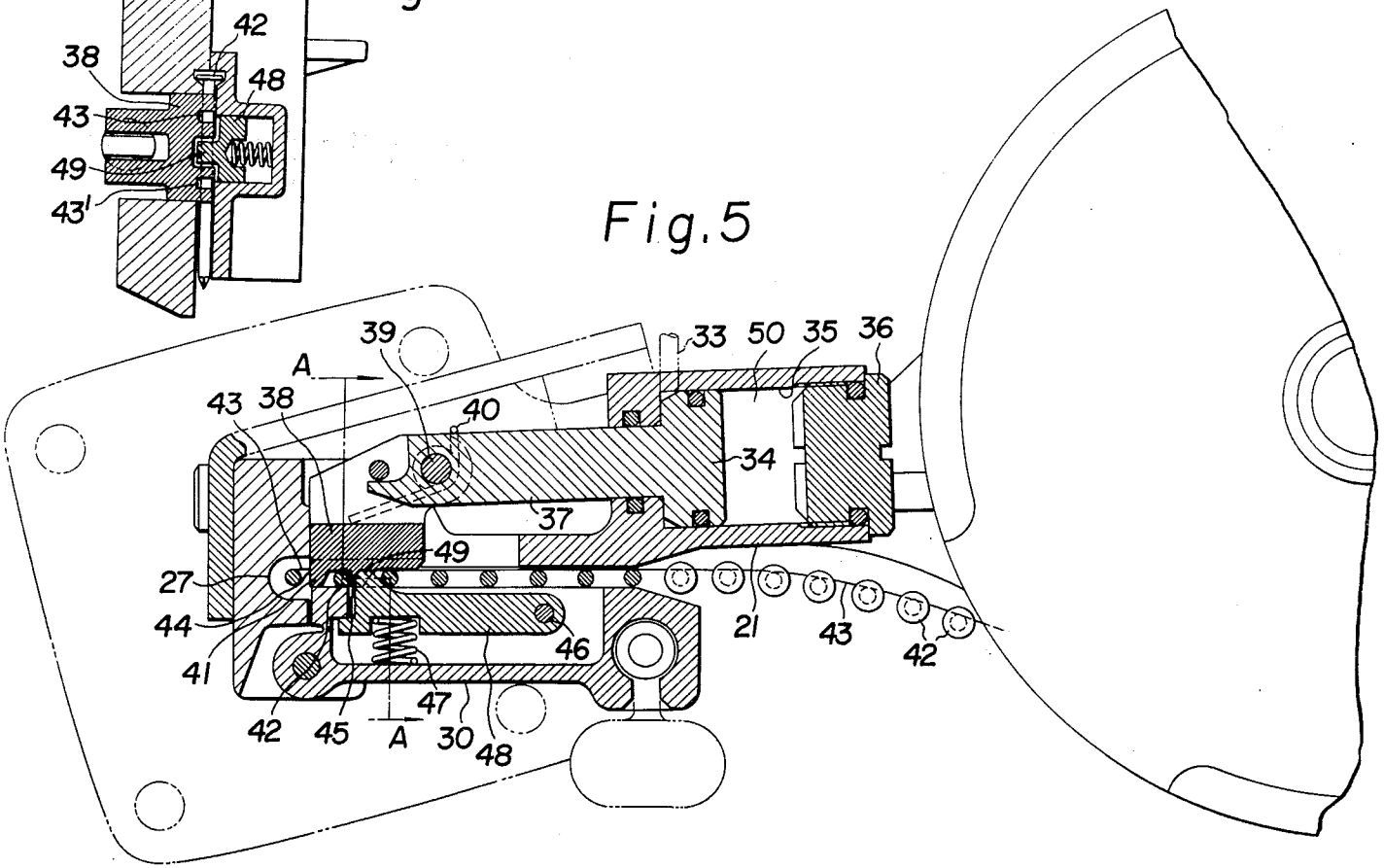
FIG. 5 is a cross section taken along the line B—B of FIG. 1.
Figure 6:
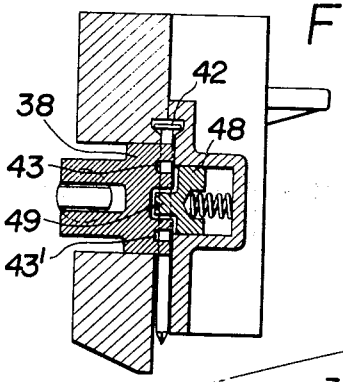
FIG. 6 is a cross section taken along the line A—A of FIG. 5.
Figure 7:
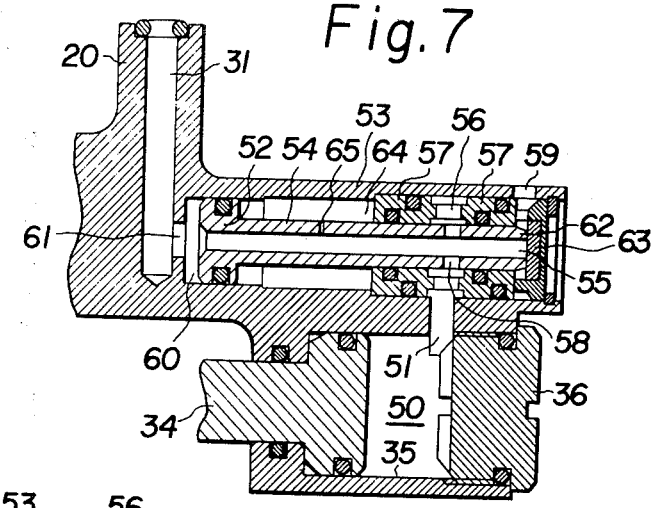
FIG. 7 is a cross section taken along the line C—C of FIG. 1.

Here follows a description of the structures of the nail feeding mechanism, which is to be read with reference to FIGS. 5, 6 and 7.

FIG. 5 is an enlarged cross section taken along the line B—B of FIG. 1, illustrating a nail feeding piston 34 disposed within a cylindrical opening 35 formed in the nail feeding piston housing 21. A piston stopper 26 is mounted in the opening 35 so as to face the free surface of the piston (on the right thereof in the drawing) for stopping the rightward motion of the nail feeding piston 34 and for sealing the opening 35. At the end of the rod 37 on the nail feeding piston 34 is fitted a nail feeding pawl 38 which is pivotal about a shaft 39. The pawl 38 is normally maintained in the FIG. 5 position by a spring 40. A pair of teeth 41 and 45, resembling those of a saw, are formed at the front end of said nail feeding pawl 38. The first tooth 41 formed at the utmost end (the left end in FIG. 5) has an edge 44 to cut a steel wire 43 that connects nails 42. In contrast, the second tooth 45 holds the next nail 42 adjacent and directly behind the first tooth 41 so as to permit feeding of the next nail into the bottom end of the driver passage 27. The distance between the teeth 41 and 45 is smaller than the connecting pitch of the nails 42.

On the inside of the door 30 there is provided a nail return preventing pawl 48, which pawl is free to pivot about a shaft 46 and is pressed against the nails 42 and the nail feeding pawl 38 by a spring 47. This nail return preventing pawl 48 is formed with a projection 49 having an inclined surface, so that it offers no obstruction when the nails 42 advance (move leftwardly in FIG. 5), while it prevents the nails 42 from being carried along with the nail feeding pawl 38 when it moves in the opposite direction (rightwardly in FIG. 5).

Now details of said nail feeding pawl 38 and nail return preventing pawl 48 will be described with reference to FIG. 6.

The nail feeding pawl 38 is provided with grooves which permit the nail connection steel wires 43 and 43' to pass therethrough, which grooves extend through both teeth. Pawl 38 also has a groove to receive said projection 49 of the nail return preventing pawl 48.

Here follows a description as to the structure of a quick exhaust piston as shown in FIG. 7.

For quickly exhausting the air in the chamber 50 above the nail feeding piston 34, there is provided a passage 51 which communicates with cylindrical opening 35 and which opens into a cylinder chamber 53 through which a quick exhaust piston or valve 52 slides. The exhaust piston 52 has an air pressure 55 in its central portion which passes through its rod portion 54. The cylinder chamber 53 is provided with an annular guide 57 in which an air passage 56 is formed opposite to said passage 51. This guide 57 sealingly engages both the rod 54 and the inner wall of the cylinder 53. The air passage 56 communicates with the passage 51 and also communicates with said air passage 55 through an opening 58 provided opposite to said passage 56 in the rod 54. At the rod-end side of the cylinder chamber 53 there is provided an opening 59 communicating with the atmosphere. On the other hand, in the end surface of an air chamber 60 that is formed above (on the left in the drawing) the quick exhaust piston 52 in the cylinder chamber 53, there is provided an opening 61 that communicates with the air passage 31 in the air passage housing 20. Also, on the rod-end side (on the right in the drawing), the end surface of the cylinder chamber 53 is fitted with a valve seat 63 which, on contacting the end surface 62 of the rod 54, disconnects the opening 59 from the air passage 55. An air chamber 64 formed in the cylinder chamber 53 between the guide 57 and the piston 52 communicates with the air passage 55 through a small-diameter opening 65 formed in the rod 54.

Figure 8:
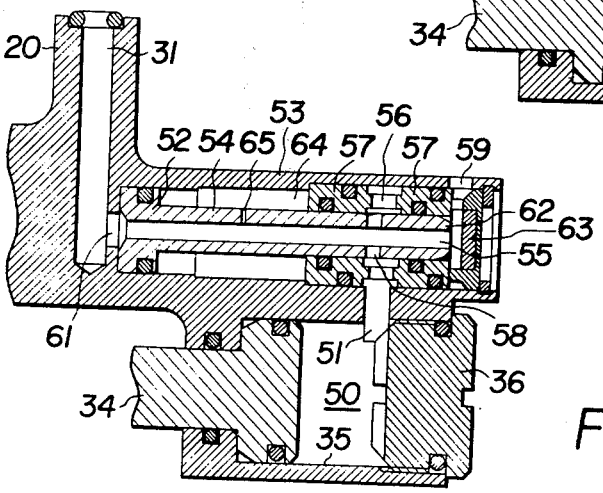
FIG. 8 through 12 are cross sections illustrating the moving conditions of a nail feeding mechanism.

The nail feeding mechanism having the above-described structure operates as follows: By manually pushing up the trigger valve 16 shown in FIG. 1 into the FIG. 3 position, this causes the air reservoir 15 to be opened to the atmosphere through the trigger valve opening 18. Since the nail feeding mechanism is in a standstill position as shown in FIG. 5 and 7, then the compressed air in the air chamber 60 and air passage 55 escapes into the atmosphere through the air passage 19 and 31 (FIG. 2). Because the small-diameter opening 65 provided in the rod 54 offers great resistance, the pressure within the air chamber 64 does not fall rapidly. Accordingly, the quick exhaust piston 52 is moved to the left, as illustrated in FIGS. 7 and 8, under the influence of expansion of compressed air within the chamber 64. At this time, the main piston 5 stays in its advanced position shown in FIG. 4. When the end surface 62 on the rod 54 separates from the valve seat 63, the air passage 55 is opened to the atmosphere through the opening 59. Also, the air chamber 50 above the nail feeding piston 34 communicates with the atmosphere through the passage 51, air passage 56, opening 58, air passage 55 and opening 59. This permits a quicker evacuation of air from above the nail feeding piston so as to permit a quicker return of the piston to its retracted position, whereby the nails may be fed into the driver passage 27 at a more rapid rate.

Figure 9:
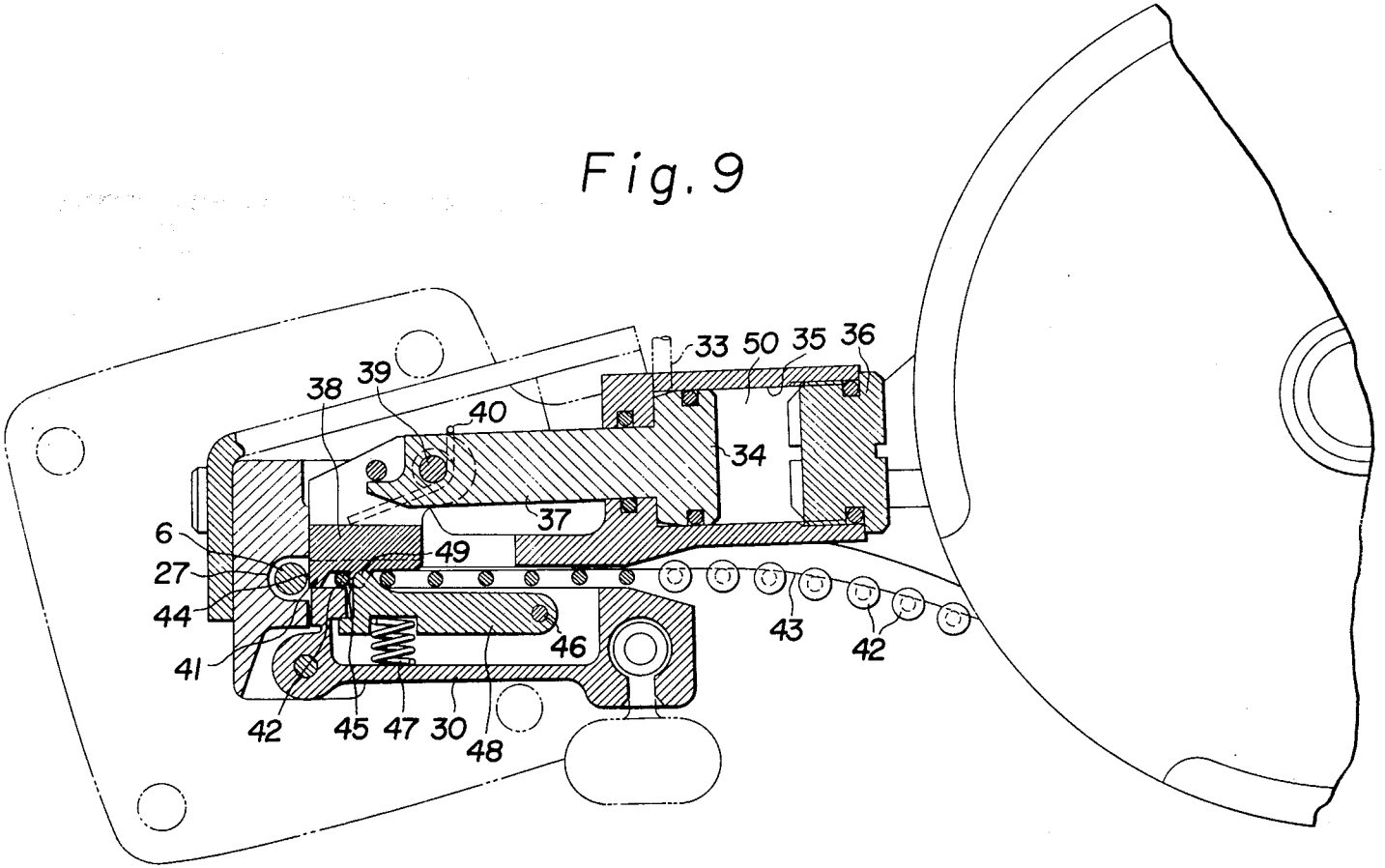
Figure 11:
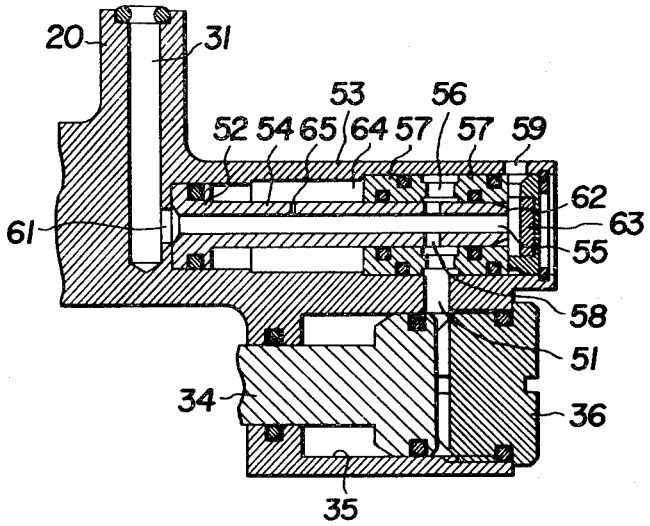

Then, when the main piston 5 reaches its lowermost position as shown in FIG. 4, that is, when the driving of a nail has been completed, compressed air flows through the small-diameter opening 22, the piston returning air reservoir 13, and the air passages 32 and 33 so as to be supplied below the nail feeding piston 34 (see FIG. 9). This causes the nail feeding piston 34 to be retracted (rightwardly in FIGS. 9 and 10), thereby expelling the air from the air chamber 50 and impinging the piston 34 on the piston stopper 36. This movement of the nail feeding piston 34 to the right is carried out quickly because the air chamber 50 has previously communicated with the atmosphere through the passage 51, air pressure 56, opening 58, air passage 55 and opening 59 as described above.

Figure 10:
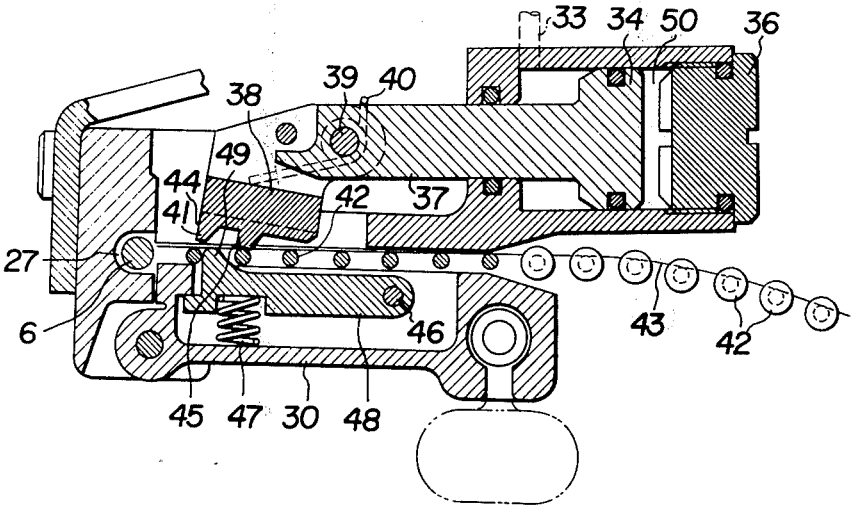
Figure 12:
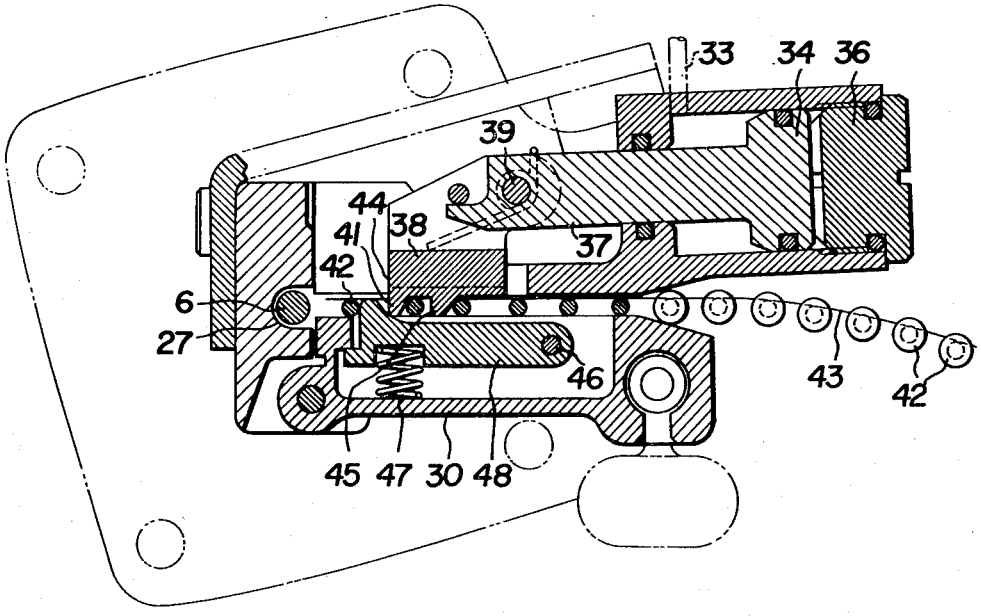

As illustrated in FIG. 10, the nail feeding pawl 38 moves to the right when the piston 34 is retracted whereupon the sloped rear surfaces on the teeth 41 and 45 engage the nails 42 and cause the pawl 38 to swing upwardly (clockwise) about the shaft 39. When fully retracted, spring 40 urges the pawl 38 downwardly between the nails as shown in FIG. 12. On releasing the trigger valve 16 of FIG. 1 to close the trigger valve opening 18 and open the trigger valve air port 17, compressed air inside the air chamber 3 is introduced into the air chamber 50 through the trigger valve air port 17, air reservoir 15, air passages 19 and 31, and opening 61. By this means, the quick exhaust piston 52 returns to the original position shown in FIG. 7, thereby closing the opening 59. Then, the air reaches the air chamber 50 through the air passage 55, opening 58, air passage 56 and passage 51, thus returning the nail feeding piston 34 to its advanced position as shown in FIG. 5. At this time, the second tooth 45 moves the second nail 42 to the left by one step, and feeds the first nail 42 into the driver passage 27. Because the pitch of the teeth 41 and 45 is smaller than the connecting pitch of the nails 42, the nail 42 is perfectly sent into the driver passage 27. The cutting edge 44 formed at the front end of the first tooth 41 is adapted to cut the nail connecting steel wires 43 and 43' when the driver 6 drives the nail 42 downwardly, which cutter 44 prevents the descending motion of said wires.

Now a nail feeding magazine will be described in the following paragraphs.

Figure 13:
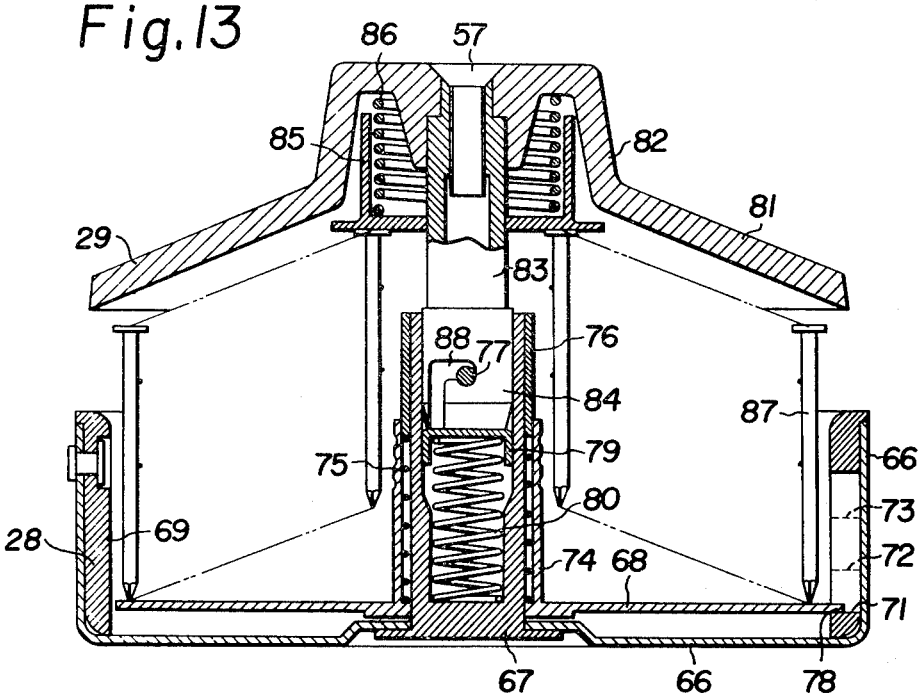
FIG. 13 is a cross section taken along the line D—D of FIG. 1, illustrating that nails of maximum length are loaded.
Figure 16:
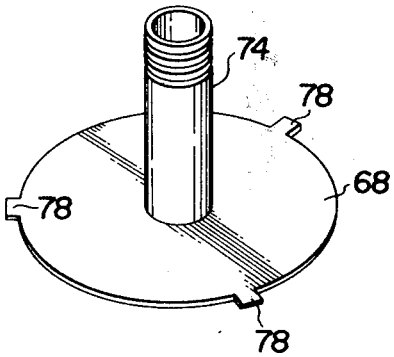
FIG. 16 is a perspective view of a nail placing plate shown in FIG. 13.
Figure 17:
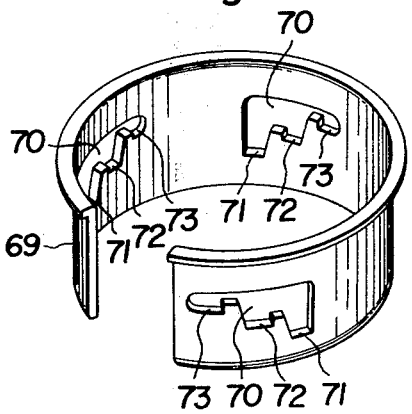
FIG. 17 is a perspective view of a ring for adjusting the fitting position of the nail placing plate.

FIG. 13 is a cross section showing a nail magazine 28 according to this invention. At the center of the magazine housing 66 there is projectingly provided a magazine cylinder 67, and a nail placing plate 68, made of a flat plate, is inserted thereinto. A position adjusting ring 69, which is adapted to adjust the fitting position of said nail placing plate 68, is fixed to the cuplike housing 66. A plurality of windows 70 (FIG. 17) are formed in the cylindrical wall portion of said ring 69. Each window 70 is formed with a suitable number of differently stepped engaging indentations 71, 72, 73. As shown in FIG. 16, said nail placing plate 68 is disklike in shape, with a tubular shaft 74, adapted to engage with said cylindrical portion 67, standing at the center thereof. The nail placing plate 68 is fixed by forcibly inserting a spring 75 in the annular space between said cylindrical portion 67 and shaft 74 and passing a pin 77 through a cover ring 76 mounted thereon and the cylindrical portion 67. Also, projections 78 are formed, as shown in FIG. 16, along the periphery of said nail placing plate 68, which projections are to be engaged with any of said stepped indentations 71, 72, 73 formed on said ring 69. A pressing member 79 is inserted in the cylindrical portion 67, with a spring 80 placed between said pressing member 79 and the lower end of the cylindrical portion 67 so as to always push said pressing member 79 upward.

The magazine cover 29 looks like a hat in shape, with its central portion being swollen upward to form a knob 82. A cylindrical fitting shaft 83 is provided, consisting of a small-diameter upper portion and a large-diameter lower portion 84. A cylindrical nail pressing member 85 is slidably engaged on said upper shaft portion, so that it presses downward the nails 87 which are loaded in a spiral conical arrangement, by the action of a spring 86 interposed between the pressing member 85 and said knob 82 of the magazine cover 29. In this way, the position of the nail which is to be fed out of the magazine is kept constant by being engaged with the plate 68. Also, a guide passage 88 is provided in said large-diameter portion 84, which opens at the lower end and bends in the upper portion. An engaging indentation is formed in the furthermost portion of said guide passage 88, so as to receive said pin 77.

The following is a description as to the loading of nails.

Figure 14:
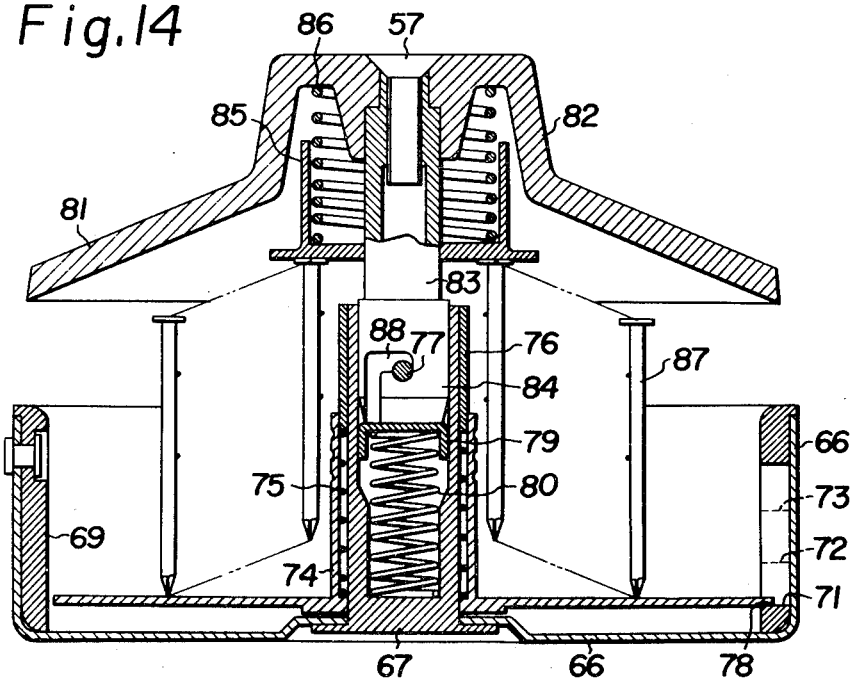
FIG. 14 is a cross section similar to FIG. 13, excepting that the nails have decreased in number.
Figure 15:
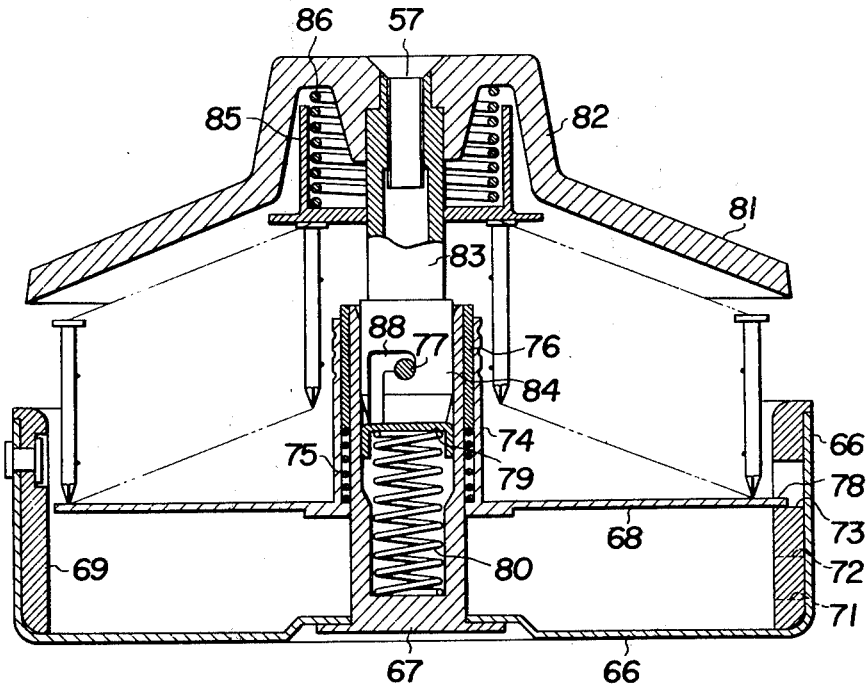
FIG. 15 is a cross section of a nail magazine in which shorter nails are loaded.

According to the length of nails, the nail placing plate 68 is raised against the force of the spring 75, and rotated in order that projections 78 formed thereon are engaged with any of engaging indentations 71, 72, 73 which are formed stepwise in the windows 70. FIG. 13 shows a condition in which long nails are used, while FIG. 15 shows a condition where short nails are used. Following this, the fitting shaft 83 of the magazine cover 29 is inserted into the cylindrical portion 67 so as to depress the pressing member 79 against the action of the spring 80, and the pin 77 is engaged with the receiving indentation in the guide passage 88. By so doing, the magazine cover 29 is fitted to the magazine housing 66, and the nail pressing member 85 always depresses a number of wire-stringed nails 87, irrespective of the remaining quantity thereof (see FIG. 14).

Being so constructed and adapted to be operated as described above, the device according to this invention produces many excellent effects as given hereunder.

Since the nail feeding piston 34 is pneumatically operated in phase with the main piston 5, no mistaken lead or lag occurs in the nail feeding operation, thus achieving perfect synchronization. The use of pneumatic pressure eliminates the need for a mechanical interlocking etc., which results in extensive reduction in nail feeding troubles.

Provision of a device that permits quick evacuation of working air for the nail feeding piston insures a quick and reliable nail feeding operation. Compared with conventional devices, this machine increases working efficiency by making it possible to drive a greater number of nails per unit time.

Resilient engagement of the nail feeding piston with the nail feeding pawl allows a smooth nail feeding operation, thereby increasing quick operativity and durability of the device.

Provision of a cutting edge at the front end of the nail feeding pawl permits accurate cutting of the nail connecting steel wire, synchronized with the nail driving operation of the main piston.

Because a flat nail placing plate is fitted to the magazine, and a number of spirally and conically wound nails are placed thereon and held by a movably and resiliently depressing nail pressing member, the position of the nail fed out of the magazine is always kept constant, irrespective of the quantity of nails remaining therein.

Finally, this pneumatically operated nailing machine may be used for extensive purposes, irrespective of the length of nails to be used, since a device to change the vertical position of the nail placing plate is provided in the magazine housing.

The embodiment of the invention in which an exclusive property or privilege is claimed are defined as follows:

1. In a pneumatically operated nailing machine including housing means;

driving means associated with said housing means for permitting driving of a nail, said driving means including a driving member mounted for reciprocating movement along a first line of movement and adapted for driving a nail to thereby eject the nail from the machine, said driving means also including a driving piston interconnected to said driving member for reciprocating same;

nail feeding meeans for positioning a nail in a selected location wherein said nail is adapted to be contacted and driven by said driving member, said nail feeding means including a nail feeding piston mounted for reciprocating movement along a second line of movement which is substantially transverse to said first line of movement;

means for supplying a pressurized gaseous fluid to each of said pistons for controlling the reciprocation thereof; and manually movable trigger-controlled valve means mounted on said housing means, first passage means for supplying pressurized fluid to said trigger-controlled valve means, and second passage means for supplying pressurized fluid from said trigger-controlled valve means to said driving piston and said nail feeding piston for causing movement of said pistons, said second passage means including first and second passageways for controlling flow of pressure fluid to said driving piston and said nail feeding piston respectively, comprising the improvement wherein shiftable exhaust valve means is associated with said second passageway, said shiftable exhaust valve means permitting an advancing chamber associated with said nail feeding piston to be selectively disposed in communication with an exhaust passage which communicates with the surrounding atmosphere.

2. A machine according to claim 1, including a nail holding magazine mounted on said housing means for holding therein a conical nail unit which includes a plurality of nails fixed to an elongated connecting wire wound in a conical form, said magazine including a substantially flat base plate adapted to support the conical nail unit thereon, and said magazine also including a movable and resiliently urged pressing member spaced opposite said base plate and disposed in engagement with said nail unit for confining said nail unit between said pressing member and said base plate.

3. In a pneumatically operated nailing machine including housing means;

driving means associated with said housing means for permitting driving of a nail, said driving means including a driving member mounted for reciprocating movement along a first line of movement and adatped for driving a nail to thereby eject the nail from the machine, said driving means also including a driving piston interconnected to said driving member for reciprocating same;

nail feeding means for positioning a nail in a selected location wherein said nail is adapted to be contacted and driven by said driving member, said nail feeding means including a nail feeding piston mounted for reciprocating movement along a second line of movement which is substantially transverse to said first line of movement; and supply means for supplying a pressurized gaseous fluid to each of said pistons for controlling the reciprocation thereof, comprising the improvement wherein the nail feeding means includes a nail feeding pawl pivotally mounted on the forward end of said nail feeding piston, said nail feeding pawl having a cutting edge on the forward end thereof for cutting a connecting wire which extends between and connects a plurality of nails, said nail feeding pawl having first and second teeth thereon adapted to engage the nails and advance same so that the frontmost nail is moved into said selected location, the teeth of said feeding pawl having groove means formed therein and extending transversely thereacross, said groove means accommodating therein the connecting wire, and the cutting edge being provided on the frontmost tooth with the connecting steel wire extending through said groove means and across said cutting edge so that advancing of said driving member causes the nail in said selected location to be driven while said cutting edge cuts said connecting wire.

4. In a pneumatically operated nailing machine including housing means;

driving means associated with said housing means for permitting driving of a nail, said driving means including a driving member mounted for reciprocating movement along a first line of movement and adapted for driving a nail to thereby eject the nail from the machine, said driving means also including a driving piston interconnected to said driving member for reciprocating same;

nail feeding means for positioning a nail in a selected location wherein said nail is adapted to be contacted and driven by said driving member, said nail feeding means including a nail feeding piston mounted for reciprocating movement along a second line of movement which is substantially transverse to said first line of movement; and supply means for supplying a pressurized gaseous fluid to each of said pistons for controlling the reciprocation thereof, comprising the improvement wherein the nail feeding means includes a nail feeding pawl pivotally mounted on the forward end of said nail feeding piston, said nail feeding pawl having a cutting edge on the forward end thereof for cutting a connecting wire which extends between and connects a plurality of nails, said nail feeding pawl having first annd second teeth thereon adapted to engage the nails and advance same so that the frontmost nail is moved into said selected location, the cutting edge being provided on the frontmost tooth with the connecting steel wire extending thereacross so that advancing of said driving member causes the nail in said selected location to be driven while said cutting edge cuts said connecting wire; and a nail holding magazine mounted on said housing means for holding therein a conical nail unit which includes a plurality of nails fixed to an elongated connecting wire wound in a conical form, said magazine including a substantially flat base plate adapted to support the conical nail unit thereon, and said magazine also including a movable and resiliently urged pressing member spaced opposite said base plate and disposed in engagement with said nail unit for confining said nail unit between said pressing member and said base plate.

5. A machine according to claim 4, including adjustment means coacting with said base plate for varying the spacing thereof from said pressing member to permit said magazine to accommodate therein nails of different length.

6. A machine according to claim 4, therein said supply means includes manually movable trigger-controlled valve means mounted on said housing means, first passage means for supplying pressurized fluid to said trigger-controlled valve means, and second passage means for supplying pressurized fluid from said trigger-controlled valve means to said driving piston and said nail feeding piston for causing movement of said pistons, said second passage means including first and second passageways for controlling flow of pressure fluid to said driving piston and said nail feeding piston respectively, and shiftable exhaust valve means associated with said second passageway, said shiftable exhaust valve means permitting an advancing chamber associated with the nail feeding piston to be selectively disposed in communication with an exhaust passage which communicates with the surrounding atmosphere.

* * * * *